United States Patent [19]

Bae

[11] Patent Number: 4,498,598

[45] Date of Patent: Feb. 12, 1985

[54] COLLAPSIBLE CONTAINER

[75] Inventor: Ik J. Bae, Taegu, Rep. of Korea

[73] Assignee: Dong Hwa Engineering Co. Ltd., Seoul, Rep. of Korea

[21] Appl. No.: 509,179

[22] Filed: Jun. 29, 1983

[30] Foreign Application Priority Data

Nov. 3, 1982 [KR] Rep. of Korea ..... 1866/82

[51] Int. Cl.[3] ..... B65D 7/24

[52] U.S. Cl. ..... 220/6; 220/4 F; 217/14

[58] Field of Search ..... 220/6, 4 F, 1.5; 217/12 R, 14, 38, 43 R, 46

[56] References Cited

U.S. PATENT DOCUMENTS 1,038,816 9/1912 Arnold ..... 220/6
3,164,281 1/1965 Williams, Jr. ..... 217/14
3,497,127 2/1970 Box ..... 220/6 X
3,874,546 4/1975 Sanders et al. ..... 220/6

FOREIGN PATENT DOCUMENTS 105176 5/1977 Rep. of Korea .

*Primary Examiner*—Steven M. Pollard
*Attorney, Agent, or Firm*—Handal & Morofsky

[57] ABSTRACT

A collapsible container for fruit is provided with simple means for interlocking the bottom plate with a wall plate so that the bottom plate is not detached from the wall plate regardless of the manner in which the container is handled. The simple means comprise at least two L-shaped projections on one side of the bottom plate each having an additional holding projection and corresponding openings in the lower part of the wall plate.

3 Claims, 5 Drawing Figures

COLLAPSIBLE CONTAINER

TECHNICAL FIELD

This invention relates to a collapsible container. More specifically, it relates to a container having means for joining the bottom plate with a wall plate when a collapsible container is collapsed and folded for storage.

BACKGROUND ART

The collapsible container of the prior art has little inconvenience when in use. However, when it is emptied, collapsed and transported somewhere, there is the drawback that the bottom plate is often detached from the wall adjacent thereto.

Such a drawback originates from the fact that the bottom plate is not interlocked with the wall plate adjacent thereto if the container is collapsed and transported somewhere.

DISCLOSURE OF INVENTION

The object of the present invention is to provide simple means for interlocking the bottom plate with the wall plate adjacent thereto so that the bottom plate is not detached from the wall plate regardless of the handling manner.

A collapsible container for fruit according to one embodiment of the present invention comprises four plates forming the front, back, left, and right walls respectively which are hinged together, and a bottom plate having at least two L-shaped projections at one side thereof, the lower part of said front wall plate having at least two openings corresponding to said L-shaped projections, characterized in that each of said L-shaped projections is formed with a holding proturberance at one side of the upper end thereof when the bottom plate placed in the horizontal position, as when the container is in use. Said at least two openings are located at the lower part of said front wall plate wherein said projections are inserted in said openings with the bottom plate placed on the front wall plate offset thereto lengthwise and the length of each of said opening is such that the bottom plate can be positioned substantially centrally of the front wall plate when said two plates are moved lengthwise relative to each other with said projections inserted in said openings.

Thus, when a collapsible container of the present invention is collapsed and transported somewhere, the bottom plate is not detached from the front wall plate by virtue of the holding protuberances.

BRIEF DESCRIPTION OF DRAWINGS

Two ways of carrying out the invention is described in detail below with reference to the drawings which illustrate only two specific embodiments of the invention, in which.

BEST MODE FOR CARRYING OUT THE INVENTION

Figure 1:
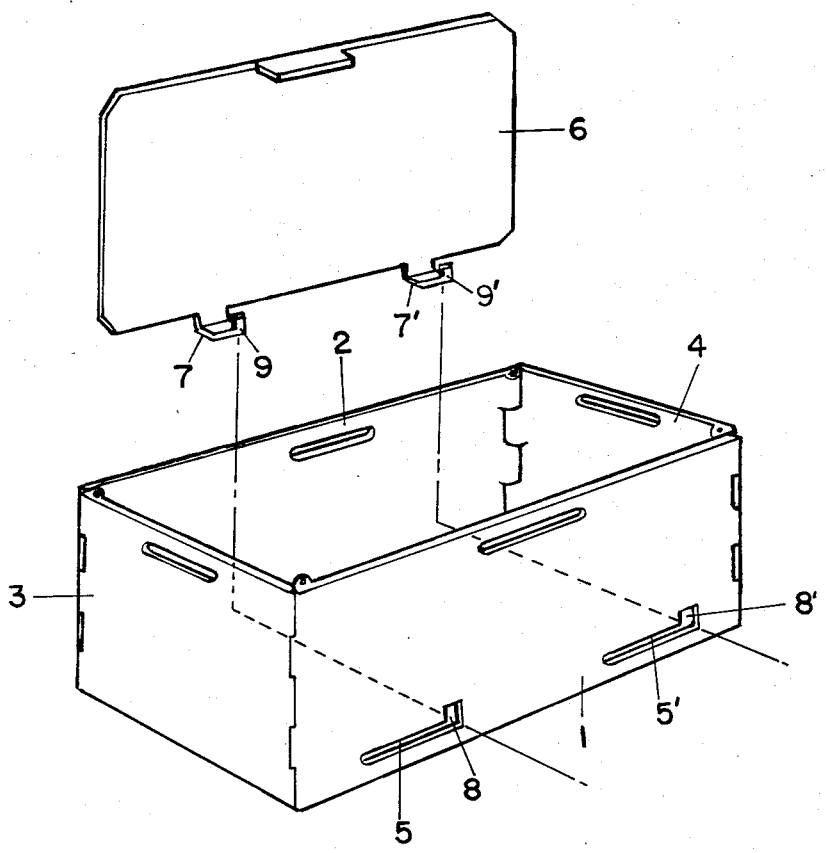
FIG. 1 illustrates a partially exploded perspective view of a preferred embodiment of the invention.

Referring to FIG. 1, a collapsible container according to a preferred embodiment of the present invention comprises a bottom plate 6 and four wall plates 1, 2, 3 and 4. The structure of the container is similar to one disclosed in the prior art except for the shapes of the L-shaped projections 7, 7' and the openings 5, 5'. The four wall plates are hingedly connected to each other.

Each of the L-shaped projections 7. 7' is formed with a holding protuberance 9, 9'. These protuberances 9, 9' are arranged inwardly parallel to the bottom plate, and are at the upper end of the L-shaped projection when the bottom plate is in the horizontal position shown in FIG. 3. The lower part of the front wall plate 1 has at least two openings 5, 5' corresponding to the L-shaped projections 7, 7'.

These openings 5, 5' are located at the lower part of the front wall plate 1 wherein the projections 7, 7' are inserted in the openings 5, 5' with the bottom plate 6 placed on the front wall plate and offset lengthwise with respect thereto.

The size of the enlarged portions 8, 8' of the openings 5, 5' are such that the protuberance 9, 9' of the projections 7, 7' can be inserted therein. The length of the openings 5, 5' is such that the bottom plate can be positioned substantially centrally of the front wall plate when the two plates 1 and 6 are moved lengthwise relative to each other with the projections 7, 7' inserted in the openings 5, 5'.

Figure 2A:
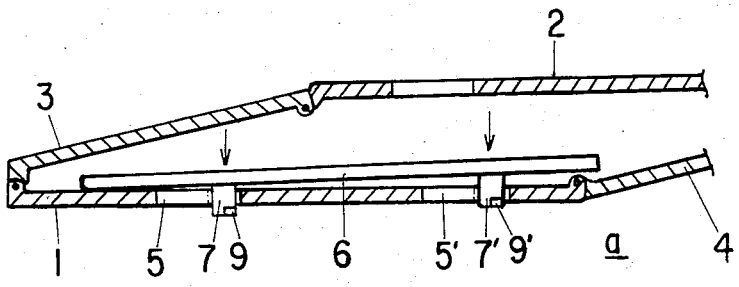
FIG. 2 is a cross-section of the collapsible container shown in FIG. 1, showing the bottom plate being attached to the front wall plate.
Figure 2B:
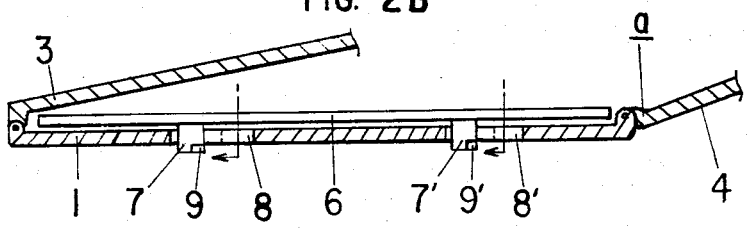

Thus, if the bottom plate 6 is placed on the front wall plate 1 offset lengthwise with the projections 7, 7' inserted in the openings 5, 5' as shown in FIG. 2A and is moved to the left as shown in FIG. 2B so that it is positioned substantially centrally of front wall plate 1, the protuberances 9, 9' are retained by the upper wall portion of the narrow-part of the openings 5, 5'.

Figure 3:
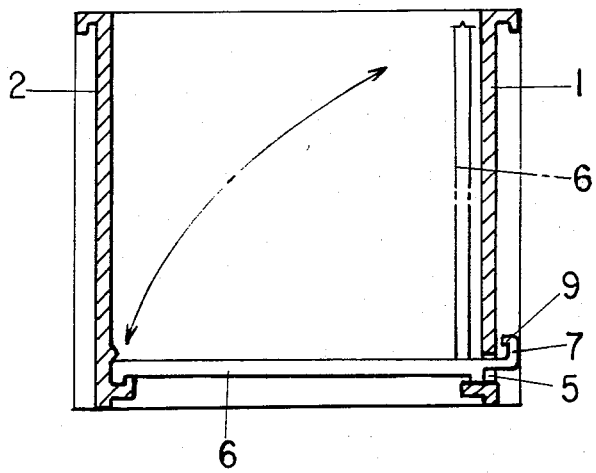
FIG. 3 is a cross-section of the collapsible container shown in FIG. 1, in which the bottom plate is placed in the horizontal position.

In use, the bottom plate 6 is lowered and placed on flanges of the lower end portions of the wall plates 1, 2, 3, 4 as shown in FIG. 3.

When the box is emptied and collapsed in order to transport somewhere, the holding protuberances 9, 9' of the projection 7, 7' are retained in the upper wall portion of the narrow part of the openings 5, 5' as shown in FIG. 3 so that the bottom plate 6 is not detached from the front wall plate 1 regardless of the manner of handling. Bottom 6 is also shown in the vertical position by dashed lines in FIG. 3.

Figure 4:
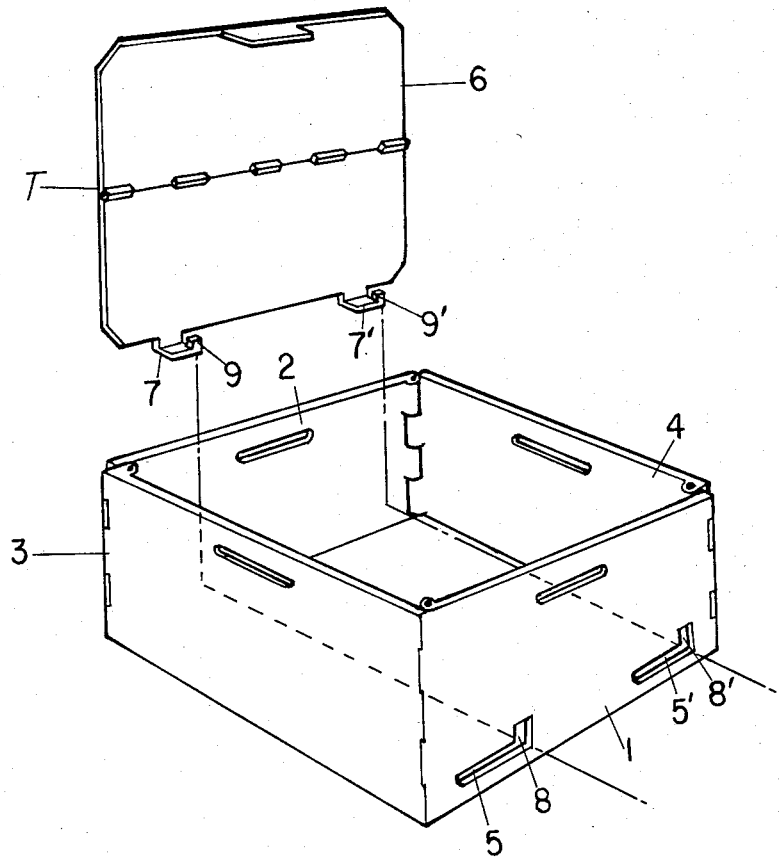
FIG. 4 is a perspective view of another embodiment of the present invention.
Figure 5:
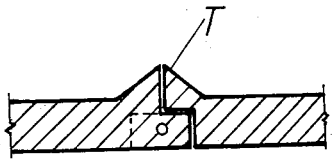
FIG. 5 is an enlarged cross-section showing supporting projections (T) along the boundary line of the two halves of the bottom plate of the embodiment shown in FIG. 5.

In another embodiment shown in FIG. 4, the collapsible container is square and therefore, the bottom plate 6 is half folded by a hinge. Along the boundary line of the two halves of the bottom plate is formed supporting projection (T) on the upper face of the bottom plate so that the bottom plate is not collapsed with the load in use. See FIG. 5.

While illustrative embodiments of the present invention has been described, it is, of course, understood that various modifications will be obvious to those of ordinary skill in the art. Such modifications are within the spirit and scope of the invention which is limited and defined only by the appended claims.

I claim:

1. A collapsible container comprising four plates forming the front, back, left and right walls respectively, said walls being hingedly connected to one another, said container further comprising a bottom plate having at least two L-shaped projections at one side thereof, the lower part of said front wall having at least two openings corresponding to said L-shaped projections, said L-shaped projections being characterized by having holding protuberances substantially parallel to the surface of said bottom plate, said two openings being characterized by having a variable cross section sufficiently large in part to allow said L-shaped projections to pass therethrough when said bottom plate is placed on said front wall, and sufficiently small in part to prevent said L-shaped projections from passing therethrough when the respective positions of said front wall and said bottom plate are changed.

2. A collapsible container as in claim 1, wherein when said L-shaped projections are inserted in said openings with the bottom plate placed on the front wall and offset lengthwise with respect thereto, the length of said openings is such that the bottom plate may be positioned substantially contrally with respect to said front wall and when so positioned said L-shaped projections are prevented from passing through said openings.

3. A collapsible container as in claim 2 when said bottom plate is hinged in such a manner so that it will support a substantial force exerted upon it from the interior of said container.

* * * * *